US012082730B2

(12) United States Patent
Warren

(10) Patent No.: US 12,082,730 B2
(45) Date of Patent: Sep. 10, 2024

(54) GARMENT HANGERS AND SIZERS AND METHOD FOR REUSING THE SAME

(71) Applicant: Prosperity Products (HK) Limited, Central (HK)

(72) Inventor: Michael Warren, London (GB)

(73) Assignee: Prosperity Products (HK) Limited, Central (HK)

( * ) Notice: Subject to any disclaimer, the term of this patent is extended or adjusted under 35 U.S.C. 154(b) by 349 days.

(21) Appl. No.: 17/487,400

(22) Filed: Sep. 28, 2021

(65) Prior Publication Data

US 2022/0061569 A1 Mar. 3, 2022

Related U.S. Application Data

(62) Division of application No. 16/217,473, filed on Dec. 12, 2018, now Pat. No. 11,266,259.

(60) Provisional application No. 62/598,209, filed on Dec. 13, 2017.

(51) Int. Cl.
*A47G 25/14* (2006.01)

(52) U.S. Cl.
CPC ..... *A47G 25/1414* (2013.01); *A47G 25/1421* (2013.01); *A47G 2200/125* (2013.01)

(58) Field of Classification Search
CPC ..... A47G 25/1414; A47G 25/1421; A47G 2200/125
See application file for complete search history.

(56) References Cited

U.S. PATENT DOCUMENTS 5,687,887 A * 11/1997 Bond ..... A47G 25/1435 40/322
6,484,390 B1 * 11/2002 Gouldson ..... B03B 9/061 29/403.1
6,523,240 B1 * 2/2003 Gouldson ..... B03B 9/061 29/426.6
6,681,966 B2 * 1/2004 Gouldson ..... A47G 25/1435 40/322
8,833,618 B2 * 9/2014 Mainetti ..... A47G 25/1435 40/322
9,155,413 B2 * 10/2015 Mainetti ..... A47G 25/1435
9,386,873 B2 * 7/2016 Gouldson ..... A47G 25/30
9,706,866 B2 * 7/2017 Mainetti ..... A47G 25/1435
(Continued)

FOREIGN PATENT DOCUMENTS

CN 1450873 A 10/2003
CN 2684685 Y 3/2005
CN 2712205 Y 7/2005

*Primary Examiner* — Lawrence Averick
(74) *Attorney, Agent, or Firm* — Downs Rachlin Martin PLLC

(57) ABSTRACT

A garment hanger and a sizer that can be removably mounted to the hanger are provided. The sizer includes a pair of inwardly extending fingers for mounting the sizer to a hook or a body of the hanger. The sizer can be manually or automatically removed from the sizer by a tool, by inserting the tool into a space between the hanger and a respective inwardly extending finger. The hanger and the sizer enable a method of reusing hangers and sizers, by automatically removing the sizers from the hangers, processing the removed hangers and sizers to provide reusable hangers and sizers. The reusable hangers and sizers are distributed to remote garment manufacturers for providing garment-on-hanger products.

19 Claims, 7 Drawing Sheets

(56) References Cited

U.S. PATENT DOCUMENTS

| | | | | |
|---|---|---|---|---|
| 2003/0136804 | A1* | 7/2003 | Gouldson | A47G 25/1435 40/322 |
| 2006/0254722 | A1* | 11/2006 | Mainetti | A47G 25/1407 156/934 |
| 2007/0158373 | A1 | 7/2007 | Yau | |
| 2007/0169882 | A1* | 7/2007 | Bode | A47G 25/32 156/305 |
| 2013/0270309 | A1* | 10/2013 | Mainetti | A47G 25/1428 40/322 |
| 2014/0250663 | A1* | 9/2014 | Mainetti | A47G 25/1407 40/322 |
| 2015/0289696 | A1* | 10/2015 | Mainetti | A47G 25/1407 40/322 |
| 2016/0051072 | A1* | 2/2016 | Gouldson | A47G 25/486 223/85 |

* cited by examiner

GARMENT HANGERS AND SIZERS AND METHOD FOR REUSING THE SAME

CROSS REFERENCE TO RELATED APPLICATIONS

This application is a divisional of U.S. Nonprovisional application Ser. No. 16/217,473, filed Dec. 12, 2018; which application claims the benefit of U.S. Provisional Application No. 62/598,209 filed on Dec. 13, 2017. Each of these applications is incorporated herein by reference.

BACKGROUND OF THE INVENTION

The present disclosure relates generally to molded plastic garment hangers as are widely used for the purpose of shipping and displaying garments. More specifically, the present disclosure relates to garment hangers and sizers that can be removably mounted to the hooks of the hangers, and a methodology of reusing the hangers and the sizers. The reuse program of the hanger and sizer saves materials, and thus, provides economic and environmentally advantageous products.

In the area of retail garment sales, so-called Garment-On-Hanger (GOH) programs have become preferred by retailers. In a GOH program, garments are delivered to retail merchants already suspended from hangers, where upon arrival at the retail location the garments are immediately placed on display for sale.

In particular, retailers have specified particular hangers or hanger characteristics among suppliers in order to achieve uniformity on their sales floors. To this end, standards as to hanger size, shape, performance characteristics, etc., are maintained, for example, by organizations such as the Voluntary Inter-industry Commerce Standards Association (VICS). Intimate apparel hangers, pinch grip hangers, top garment hangers and so on are among the standardized hangers under the VICS standards.

Additionally, and interrelated to the promulgation of GOH programs, retailers and their customers desire to have the hanger itself display some indicia regarding the item carried upon it. Categories of indicia include origin of manufacturer, materials of the garments and prices of the garments, but mostly the sizes of garments. Sizers can be secured to the hanger at any suitable location to provide a displaying surface on which garment sizes are printed.

It is an object of the present disclosure to provide a novel hanger and sizer and a combination thereof, which can be used to enable a novel reuse methodology of the hanger and sizer.

SUMMARY OF THE INVENTION

According to an exemplary aspect of the present disclosure, a garment hanger is provided. The garment hanger includes a body for hanging and displaying a garment, and a hook extending upright from the body for engaging a supporting means. The hanger further includes a sizer attachment structure configured to removably attach a sizer to a portion of the hanger. The sizer is provided with indicia for displaying at least one characteristic of the garment. The sizer attachment structure includes a web extending from a lower flange of the hanger. The web includes a front side and an opposite rear side. A first slope is provided at the front side of the web and extends toward the lower flange. A ledge is formed at the lower terminus of the first slope and formed angularly with respect to the first slope at the front side of the web. A second slope is continuous with the ledge and extends toward the lower flange. The first slope is configured to guide the movement of the sizer. The ledge is configured to engage the sizer for attaching the sizer to the sizer attachment structure. The second slope is configured to provide a space for removing the sizer.

According to another exemplary aspect of the present disclosure, a sizer suitable for attachment to a hanger is provided. The sizer includes a front panel and a rear panel substantially parallel to each other. Each panel includes a top edge and an opposite bottom edge. The sizer further includes a middle panel connecting the top edge of the front panel and the top edge of the rear panel. The front panel, the rear panel and the middle panel together form a sizer body for operatively receiving a portion of the hanger. The sizer also includes a first inwardly extending finger formed adjacent the bottom edge of the front panel. The first inwardly extending finger operatively engages the portion of the hanger for attaching the sizer to the portion in a secure yet removable manner.

According to still another exemplary aspect of the present disclosure, a combination of a garment hanger and a sizer suitable for attachment to the garment hanger is provided. The garment hanger includes a body for hanging and displaying a garment and the hook extending upright from the body for engaging a supporting means. The hanger further includes a sizer attachment structure configured to removably attach the sizer to the hanger. The sizer is provided with indicia for displaying at least one characteristic of the garment. The sizer attachment structure includes a web extending from a lower flange of the hanger. The web includes a front side and an opposite rear side. A first slope is formed at the front side of the web and extends toward the lower flange. A ledge is formed at the lower terminus of the first slope and angularly with respect to the first slope at the front side of the web. A second slope is continuous with the ledge and extends toward the lower flange. The sizer includes a front panel and a rear panel substantially parallel to each other. Each panel includes a top edge and an opposite bottom edge. The sizer further includes a middle panel connecting the top edge of the front panel and top edge of the rear panel. The front panel, the rear panel and the middle panel together form a sizer body for operatively receiving a portion of the hanger. The sizer also includes a first inwardly extending finger formed adjacent the bottom edge of the front panel. When the sizer is being attached to the sizer attachment structure of the hanger, the first slope of the web guides the movement of the first inwardly extending finger to allow secure yet removable engagement between the first inwardly extending finger of the sizer and the ledge of the hanger.

According to yet another exemplary aspect of the present disclosure, a method of reusing hangers and sizers is provided. According to this method, a plurality of hanger-and-sizer combinations are collected, each of the combinations including a sizer removably attached to a respective hanger. The sizers are automatically removed from the hangers to provide a plurality of hangers and a plurality of sizers. The plurality of hangers and the plurality of sizers are shipped to a hanger distribution center. The plurality of hangers and the plurality of sizers are processed at the hanger distribution center to provide a plurality of sorted hangers and a plurality of sorted sizers. The plurality of sorted hangers and the plurality of sorted sizers are shipped to a plurality of remote garment manufacturers at remote locations. The plurality of sorted hangers and the plurality of sorted sizers are reused at the plurality of remote garment manufacturers to provide a plurality of garment-on-hanger products.

According to still yet another exemplary aspect of the present disclosure, a method of attaching a sizer to a hanger having a sizer attachment structure is provided. According to the method, an inwardly extending finger of the sizer is moved along a slope of the sizer attachment structure. After the inwardly extending finger passes the slope, the inwardly extending finger is engaged with a ledge of the sizer attachment structure to positively attach the sizer to the sizer attachment structure.

According to yet still another exemplary aspect of the present disclosure, a method of removing a sizer attached to a sizer attachment structure of a hanger is provided. According to this method, the sizer is manipulated to release an engagement between an inwardly extending finger of the sizer and a ledge of the sizer attachment structure. Subsequently, the sizer is moved away from the sizer attachment structure to remove the sizer from the hanger.

DETAILED DESCRIPTION

Although this invention is applicable to numerous and various types of hangers, it has been found particularly useful in the environment of garment hangers having a hook for suspending the garment hanger from a display. Therefore, without limiting the applicability of the invention to these types of hangers, the invention will be described in such configuration.

Figure 1:
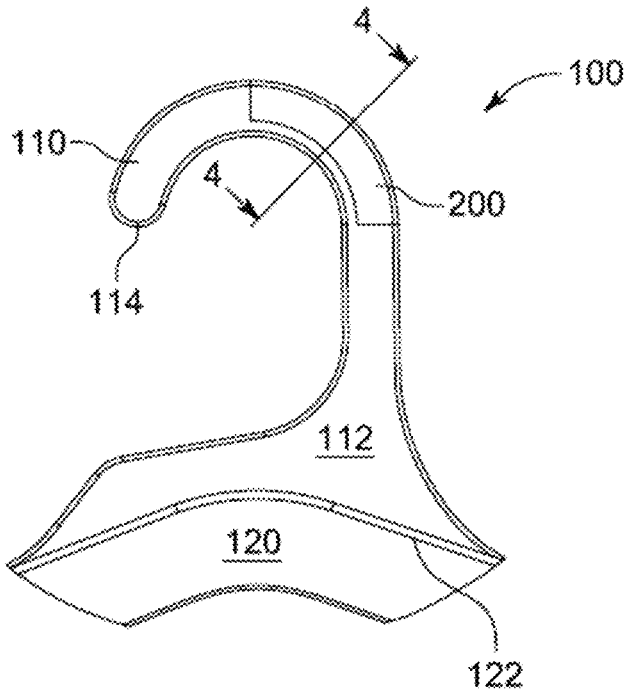
FIG. 1 is a front elevation view of a garment hanger with a sizer mounted thereto, according to an exemplary embodiment of the present disclosure.
Figure 2:
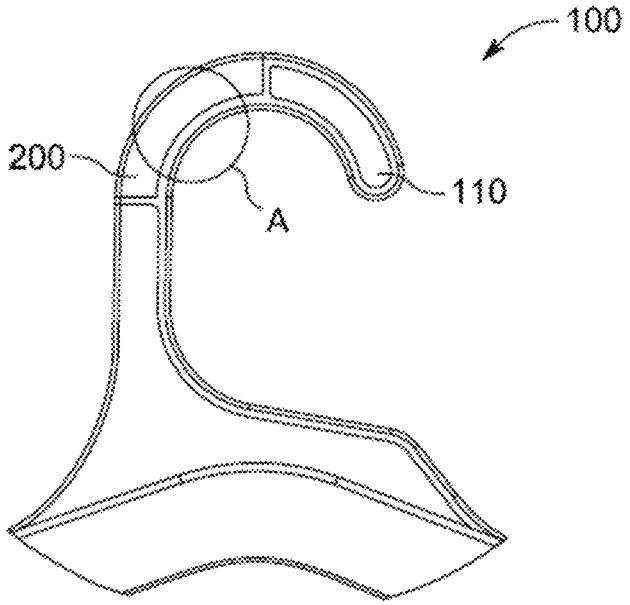
FIG. 2 is a rear elevation view of the garment hanger and the sizer, with FIG. 2A being an enlarged view of a hook region A of the hanger.
Figure 2A:
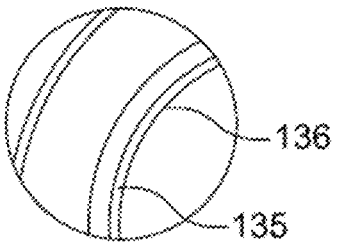

FIG. 1 depicts, in a schematic manner, a front elevation view of a garment hanger 100 and a sizer 200, according to an exemplary embodiment of the present disclosure. FIG. 2 depicts, in a schematic manner, a rear elevation view of the garment hanger 100 and the sizer 200, with FIG. 2A being an enlarged view of a hook region A of the hanger.

The hanger 100 is a molded plastic garment hanger, which can be used to support and display any suitable garment. The sizer 200 is provided with indicia for displaying at least one characteristic of the garment, typically the size of the garment. As shown in FIGS. 1 and 2, the garment hanger 100 includes a hanger hook 110, through which the hanger 100 can be supported on a display, such as, a rack, a rod or any suitable supporting means. The hook 110 includes a panel 112, which is substantially planar and defines the curvature of the hook 110. The hook 110 further includes a flange 114 substantially bordering the planar panel 112. In the shown embodiment, the flange 114 is substantially continuous and includes an upper portion and a lower portion with respect to the panel 112.

The hanger 100 further includes a hanger body 120, to which the hook 110 is uprightly connected. The body 120 is provided for hanging and displaying at least one garment. The body 120 is generally planar and can include a pair of arms (not shown) extending opposite to one another. The hanger body 120 can have any suitable configuration, such as a C-section beam, a reversed U-section beam, I-section beam and the like. The hanger body 120 includes a top flange 122, which is connected to both ends of the continuous flange 114 of the hook 110.

Figure 3A:
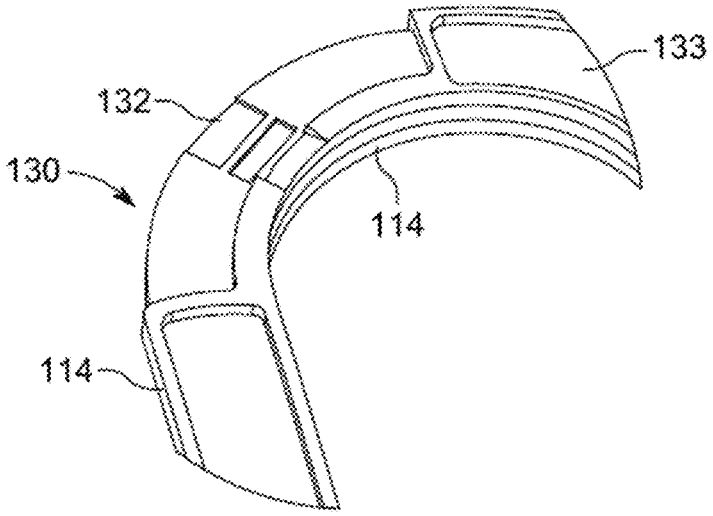
FIG. 3A is a partial rear perspective view of a hook of the hanger shown in FIGS. 1 and 2.
Figure 3B:
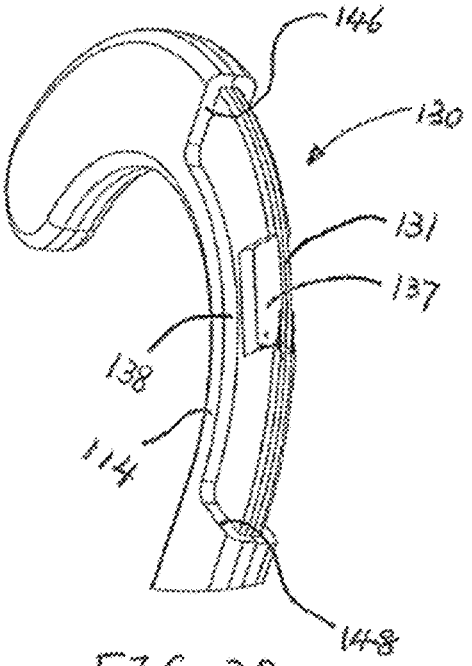
FIG. 3B is a partial front perspective view of the hook shown in FIGS. 1 and 2.

FIG. 3A is a partial rear perspective view of the hanger hook 110 for showing a sizer attachment structure 130 of the hook 110 of the hanger 100, when the sizer 200 has not been mounted to the hanger or has been removed from the hanger 100. FIG. 3B is a partial front perspective view of the hanger hook 110 for showing the sizer attachment structure 130 of the hook 110 of the hanger 100, when the sizer 200 has not been mounted to the hanger or has been removed from the hanger 100.

Figure 4:
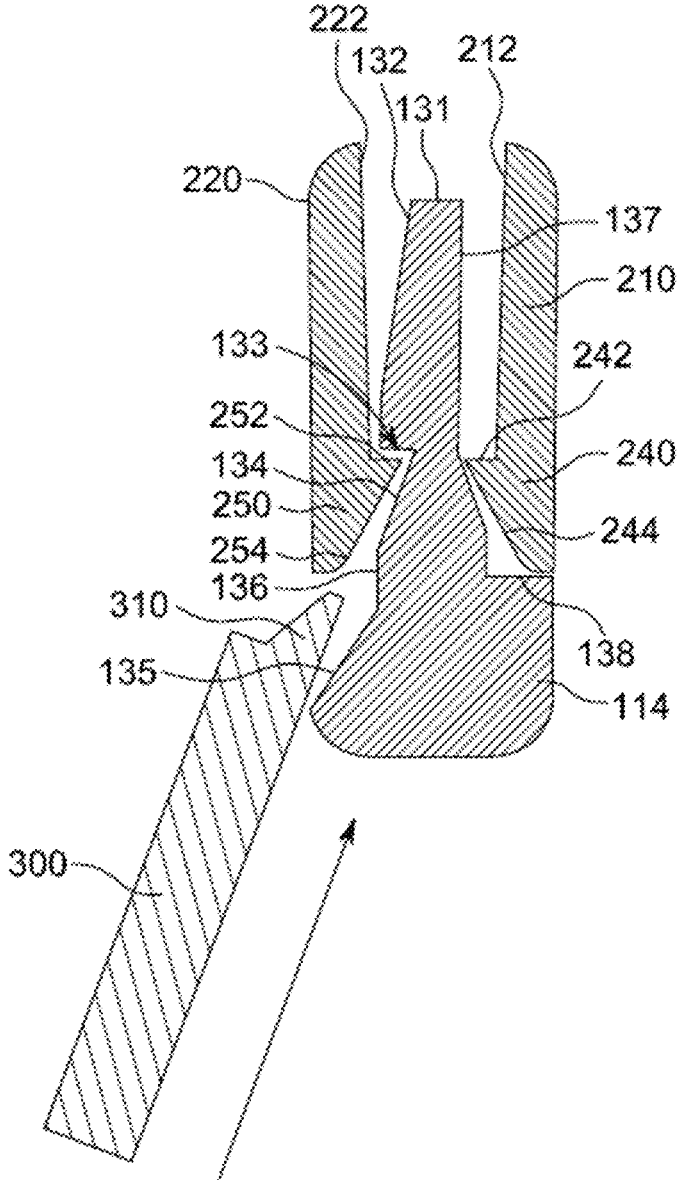
FIG. 4 is a sectional view along lines 4-4 of FIG. 1, showing the engagement of the sizer to a sizer attachment structure of the hanger.

FIG. 4 is a sectional view along lines 4-4 of FIG. 1, showing the engagement of the sizer 200 to the sizer attachment structure 130 of the hanger 100.

As shown in FIGS. 3A, 3B and 4, the sizer attachment structure 130 of the hanger 100 includes a web 131 extending from the lower portion of the continuous flange 114. The web 131 can be operatively positioned within the sizer 200, once the sizer 200 is mounted to the hanger 100. For example, the web 131 can be formed by partially removing a part of the upper portion of the continuous flange 114 of the hook 110.

In the shown embodiment, the web 131 is provided at a curved portion of the hook 110, which is adjacent to the upright portion of the hook 110, such that the web 131 substantially follows the curvature of the hook 110. The location of the sizer attachment structure 130 (or the web 131) can be selected other than shown in this embodiment. For example, the sizer attachment structure 130 (or the web 131) can be located at the free terminal end of the hook 110, which is not connected to the upright portion hook 110. In addition, the sizer attachment structure 130 can be located at suitable position of the hanger body or hanger arms, although the following detailed description of the sizer 200 and the hanger 100 is provided with respect to the exemplary embodiment in which the sizer 200 is mounted to the hook 110 of the hanger.

As shown in FIG. 4, at the rear side of the hanger 100, the web 131 includes a first slope 132 extending toward the lower portion of the flange 114, which serves to guide the movement of the sizer 200 when the sizer 200 is being mounted to the hook 110. The mounting process can be implemented either manually by a user, or automatically by a machine. The first slope 132 terminates at a ledge 133, which can be in the form of a planer surface that is angular with respect to the first slope 132. The ledge 133 can be of any suitable non-planar surface, such as, a curved or rounded surface. The ledge 133 operatively engage a first (or rear) inwardly extending finger of the sizer 200, once the sizer 200 is mounted to the sizer attachment structure 130 of the hook 110, which will be explained later with respect to the sizer 200.

A second slope 134 is provided below the ledge 133. A space is provided between the second slope 134 and the corresponding inwardly extending finger of the sizer. In operation, a removal tool 300 can be inserted into the space for manually or automatically removing the sizer 200 from the hanger 100. In addition, the sizer 200 can be manually removed from the hanger 100 with a finger of a user.

The web 131 further includes a third slope 135, which can be continuous with the second slope 134 or distanced from the second slope 134 by a transitioning surface 136. In operation, the third slope 135 (or the combination of the third slope 135 and the transitioning surface 136) can facilitate the insertion of the removal tool 300 into the space between the second slope 134 and the corresponding inwardly extending finger of the sizer.

The shape of the first slope 132 and shape of the ledge 133 are not limited to what are shown in the above embodiment. For example, the lower end of the first slope 132 can be rounded to provide a curved slope. In addition, the ledge 133 can be rounded to provide a curved engaging surface. The provision of the curved slope and engaging surface facilitates manual removal of the sizer from the hanger.

At the front side of the hanger 100, the web 131 includes a substantially upright surface 137 and a supporting surface 138. The upright surface 137 serves to guide the movement of a second (or front) inwardly extending finger of the sizer 200 (which is opposite the first inwardly extending finger configured to engage the second slope 134 and the ledge 133), to allow the second inwardly extending finger of the sizer 200 to sit on the supporting surface 138 of the web 131, once the sizer 200 is mounted to the hanger 100.

Figure 3C:
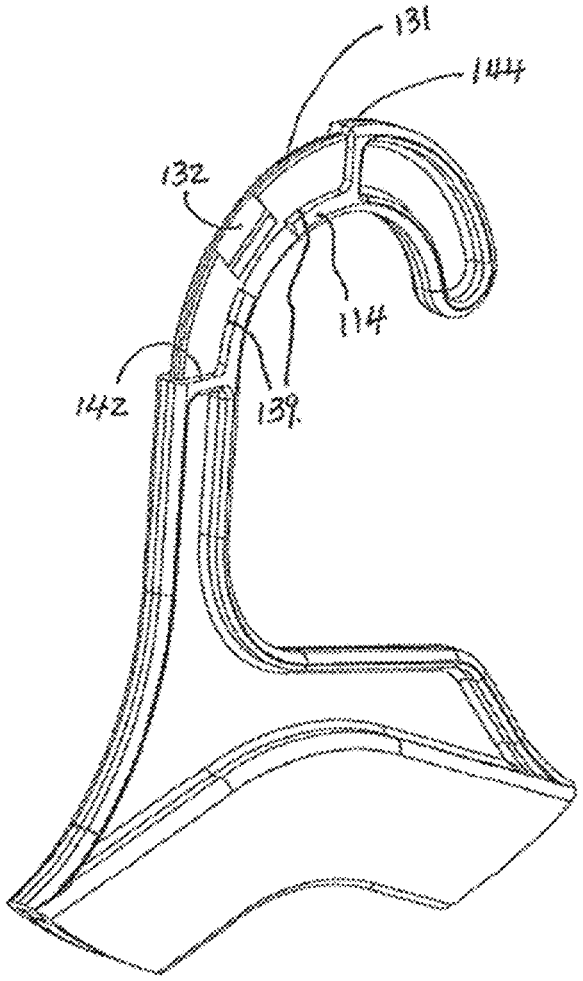
FIG. 3C is a partial rear perspective view of the hook shown in FIGS. 1 and 2.

In addition, as shown in FIG. 3C, another supporting surface 139 for supporting the sizer 200 is provided at the rear side of the hanger 100. The supporting surface 139 can be the upper surfaces of the lower portion of the flange 114, which are laterally separated from each other by the third slope 135 and the transitioning surface 136. In operation, once the sizer 200 is attached to the sizer attachment structure 130 of the hanger 100, the sizer 200 is supported by both the supporting surface 138 at the front side of the hanger 100 and the supporting surface 139 at the rear side of the hanger.

At the rear side of the hanger 100, two abutment surfaces 142 and 144 are provided, which surfaces are laterally opposite each other. Similarly, at the front side of the hanger 100, two abutment surfaces 146 and 148 are provided, which surfaces are laterally opposite each other. In operation, the provision of the abutment surfaces 142-148 facilitates the movement of the sizer 200 toward the sizer attachment structure 130 and also prevents lateral movement of the sizer 200 along the web 131 of the sizer attachment structure 130 when engaged.

In the shown embodiment, the implements for positively engaging the first inwardly extending finger of the sizer 200 is provided at the rear side of the web 131, while the implements for supporting the second inwardly extending finger of the sizer 200 is provided at the front side of the web 131. Without departing from the spirit of the present disclosure, it is understood that these implements can be reversed to be a mirror structure of the above-described embodiment.

Figure 5:
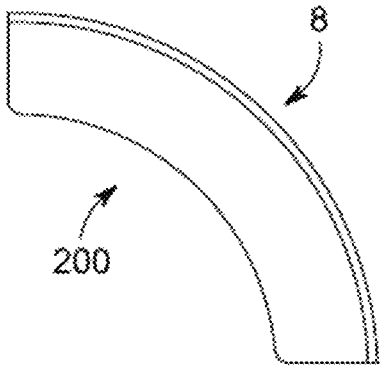
FIG. 5 is a front elevation view of the sizer shown in FIGS. 1 and 2.
Figure 6:
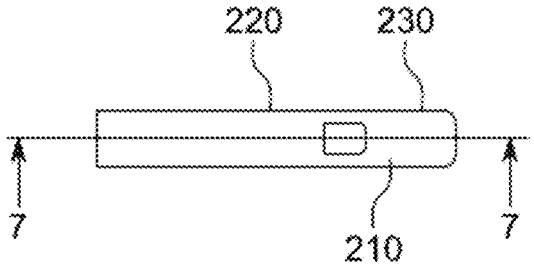
FIG. 6 is a top plan view of the sizer.
Figure 7:
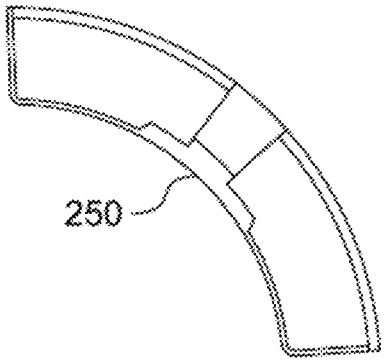
FIG. 7 is a sectional view of the sizer, along lines 7-7 of FIG. 6.

FIG. 5 is a front elevation view of the sizer 200 and FIG. 6 is a top plan view of the sizer 200. FIG. 7 is a sectional view of the sizer 200, along lines 7-7 of FIG. 6. As shown in these figures, the sizer 200 of the shown embodiment is curved to substantially conform to the curvature of the sizer attachment structure 130 of the hook 110 of the hanger 100. The sizer 200 includes a front (or first) panel 210 and a rear (or second) panel 220, which are substantially parallel with each and curved when viewed from the front or rear side of the sizer. The top edge of the front panel 210 and the top edge of the rear panel 220 are connected by a curved middle panel 230. The front panel 210, the rear panel 220 and the middle panel 230, in concert, form a sizer body, which operatively receives the web 131 of the sizer attachment structure 130 during the process of mounting the sizer 200 onto the hook 110.

In the shown embodiment, the sizer 200 has a curved profile, when viewed from the front side or rear side of the hanger 100. However, the sizer can have any suitable shape or profile (such as, rectangular, square, triangular, round, oval and the like) as long as the sizer can be operatively mounted to and removed from a corresponding part of the hanger hook or hanger body. In other words, the shape or profile of the sizer 200 and the shape or profile of the sizer attachment structure 130 of the hanger 100 can have various permutations, within the scope of the present disclosure, although the shown embodiment is preferable in practice.

Figure 8:
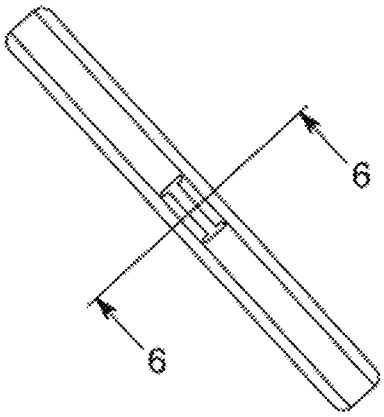
FIG. 8 is an elevation view of the sizer along arrow 8 of FIG. 5.
Figure 9:
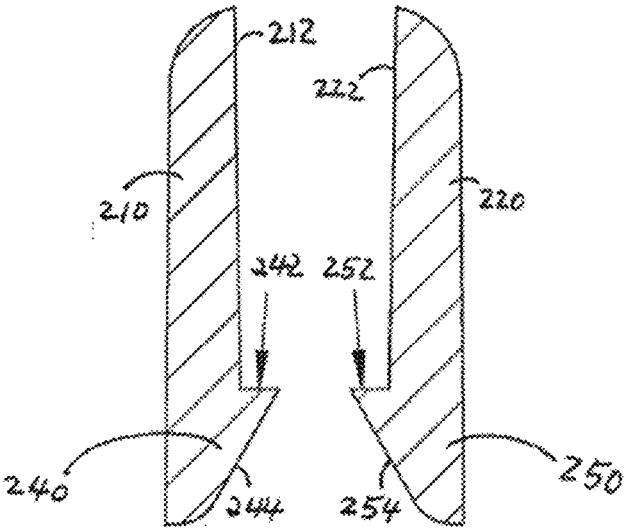
FIG. 9 is a sectional view of the sizer along lines 9-9 of FIG. 8.

FIG. 8 is an elevation view of the sizer 200 along arrow 8 of FIG. 5 and FIG. 9 is a sectional view of the sizer 200 along lines 9-9 of FIG. 8. The sizer 200 includes a pair of inwardly extending fingers 240 and 250, which are configured to operatively engage the sizer attachment structure 130 of the hook. The inwardly extending fingers 240 and 250 are best shown in FIG. 9. As shown in FIG. 9, the sizer 200 includes the first inwardly extending finger 240 integrally formed with the front panel 210 and a second inwardly extending finger 250 integrally formed with the rear panel 220.

The first inwardly extending finger 240 and the second inwardly extending finger 250 are structurally symmetric with one another and thus, include the same structural implements. The first inwardly extending finger 240 includes a first engaging surface 242, which is formed angularly with respect to an inner surface 212 of the front panel 210. The second inwardly extending finger 250 includes a second engaging surface 252, which is formed angularly with respect to an inner surface 222 of the rear panel 220. In the shown embodiment, the first engaging surface 242 and the inner surface 212 of the front panel 210 can be formed to be substantially perpendicular to each other, and the second engaging surface 252 and the inner surface 222 of the rear panel 220 can be formed to be substantially perpendicular to each other. Although in the shown embodiment both the first engaging surface 242 and the second engaging surface 252 are planar and substantially perpendicular to the respective inner surfaces, the first and second engaging surfaces can be non-planar or non-straight (such as, curved, rounded or triangular), without departing from the scope of the present disclosure.

The first inwardly extending finger 240 further includes a first sloped surface 244, which is formed angularly with respect to the first engaging surface 242. The second inwardly extending finger 250 further includes a second sloped surface 254, which is formed angularly with respect to the second engaging surface 242. Both the first sloped surface and the second sloped surface can be non-planar or non-straight (such as, curved, rounded or triangular), without departing from the scope of the present disclosure.

Next, the process of mounting the sizer 200 onto the sizer attachment structure 130 of the hook 110 will be described, assuming that the front panel 210 of the sizer 200 is mounted to the front side of the hanger 100 and the rear panel 220 of the sizer 200 is mounted to the rear side of the hanger 100.

Initially, the second inwardly extending finger 250 engages and moves along the first slope 132 of the web 131. At the same time, the first inwardly extending finger 240 moves along the substantially upright surface 137 of the web 131. This operation expands the opening of the sizer 200 between the two inwardly extending fingers to allow the web 131 to be received within the space defined between the front panel 210 and the rear panel 220 of the sizer 200.

As the second inwardly extending finger 250 moves over the first slope 132 of the web 131, the second engaging surface 252 of the second inwardly extending finger 250 engages the ledge 133 of the web 131, thereby allowing the sizer 200 to be positively, yet removably, mounted to the sizer attachment structure 130 of the hook 110.

The sizer 200, which has been mounted to the sizer attachment structure 130 of the hook 110, can be selectively removed by using the removal tool 300, as shown in FIG. 4. The removal tool 300 includes a pointed tip 310, which can be operatively inserted into a space defined between the second sloped surface 254 of the sizer 200 and the second slope 134 of the web 131. The provision of the third slope 135 and the transitioning surface 136 assists inserting the pointed tip 310 of the removal tool 300 (or a finger of a user's hand) into the space. As the pointed tip 310 of the removal tool 300 (or the finger of the user) is inserted into the space, a releasing force can be applied to the sizer 200 to release the engagement between the second engaging surface 252 of the second inwardly extending finger 250 and the ledge 133 of the web 131 of the sizer attachment structure 130.

The hanger 100 can be formed of one or more of polystyrene, SAN, ABS, PPO, nylon, polypropylene (PP), polyethylene, PET, polycarbonates (PC), acrylics, K-resin, and polyvinyl chloride (PVC) among others. From the foregoing illustrations it is readily apparent that the present disclosure is directed to an improved garment hanger and sizer suitable for industry mass production.

The present disclosure offers reliable mechanical performance and structural integrity to both the hangers and the sizers. Under industry standards, such as the VICS, it is required to maintain a certain degree of affixation of the sizer to the hanger to avoid young children from swallowing the sizer after the sizer is accidentally detached from a hanger, so as to provide so-called "child proof" hangers. The sizers according to the above-described embodiments of the present disclosure are "child proof". On the other hand, the sizers can be readily removed by an adult, with or without a tool, for the purpose of reusing the removed sizer.

The hanger 100, the sizer 200 and the removal tool 300, as described previously with respect to the embodiments shown in FIGS. 1-9, can be used in connection with a methodology of reusing hangers and sizers according to another exemplary aspect of the present disclosure.

Figure 10:
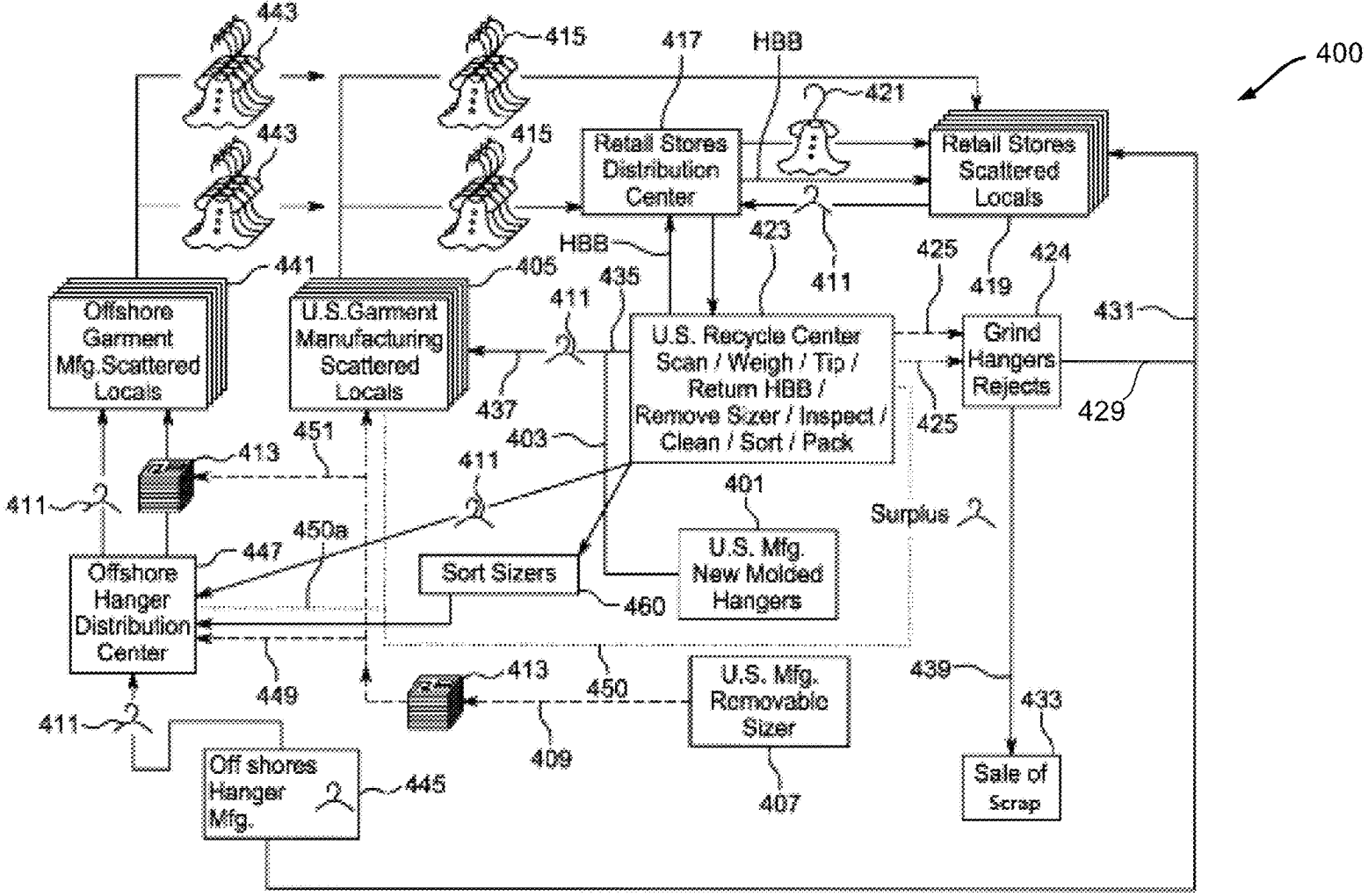
FIG. 10 is a flow chart of a method for re-using hangers and sizers according to another exemplary aspect of the present disclosure.

FIG. 10 depicts a flow chart of a method 400 for re-using hangers (such as, the hangers 100) having sizers (such as, the sizers 200) removably mounted thereon, according to another aspect of the present disclosure.

As shown, a hanger manufacturing center 401 (which can be located in the U.S. or offshore, and is typically offshore nowadays) molds hangers (such as, the hangers 100) and ships the hangers via a distribution channel 403 to a plurality of garment manufacturers 405 at scattered geographic locales. While a single group of garment manufacturers 405 are illustrated in FIG. 10, it should be noted that in actual practice, there may be hundreds of garment manufacturers that supply garments to any large retail outlet.

Simultaneously, a plurality of removable sizers (such as, the sizers 200) are molded at a sizer manufacturing center 407 (which can be located in the U.S. or offshore) and shipped in bundles 413 via a distribution channel 409 to these same garment manufacturers 405.

At each of the plurality of garment manufacturers 405, a single hanger 411 and a single sizer 413 are assembled with the garment manufactured by the U.S. garment manufacturing facility at that geographic local. The sizer represents at least one characteristic of the garment, and preferably indicates the size of the garment as denoted in the country in which the retail store to which the garment is to be shipped is located. A plurality of hangers, garments and sizers are then batched as illustrated at 415, and the batch is shipped to a retail store 419 or a regional distribution center 417 operated by the retail store 419. At each retail store 419, one or more Hanger Big Boxes (HBBs) are provided. Each HBB has a barcode attached to an outer surface of the HBB, which can be scanned and decoded by a machine, such as, a computer. Each HBB includes a lid, a base and a collapsible carton part between the lid and the base. The lid and the base can be formed by a plastic material. One or more clips can be provided to lock the lid/base with respect to the carton part.

The regional distribution center 417 provides a supply of garments on hangers 421 to the various retail stores 419 at scattered geographic locations for sale to consumers. At the point of sale in the retail store 419, the garments are removed from the hangers 411 and the hangers 411 are placed into the HBBs to be returned to the regional distribution center 417. It is within the scope of the present disclosure that all the hangers are returned to the regional distribution center 417, although in practice 10-25% of the hangers shipped from the distribution center to the retail store as garments on hangers 421 are not returned but are sold with the garment to the consumer or are damaged or otherwise lost in use.

At the regional distribution center 417, the hangers are batched in the HBBs and sent to the reuse/recycle center 423, where a plurality of operations are implemented. The operations include, but are not limited to, automatically removing the sizers from the hangers; inspecting, sorting, cleaning and packing the hangers; and inspecting, sorting, cleaning and packing the removed sizers. Optionally, the removed sizers can be transported to a sizer reuse/recycle center 460, wherein the removed sizers are inspected, sorted, cleaned and/or packed. The processed sizers are subsequently transported to a regional hanger distribution center 447 (which is typically offshore), from either the reuse/recycle center 423 or the sizer reuse/recycle center 460. The regional hanger distribution centers 447 may be located in such diverse geographic locales as Hong Kong, India or Turkey and intended to serve clusters of manufacturing entities located within a few hundred miles of the regional distribution center.

At the reuse/recycle center 423, the HBBs are weighed and the barcodes of the HBBs are scanned, for the purpose of collecting data that can be used to monitor the return rate of each store. In the event that the return rate of certain stores drops below an acceptable level, actions can be taken to ensure that the return rate is elevated to the acceptable level.

Subsequently, at the reuse/recycle center 423, the hangers and the sizers are unloaded from the HBBs onto a conveyor system. The HBBs are disassembled at the reuse/recycle center 423 by flattening the carton body and stacking the lid, base and clips on the carton body. The disassembled HBBs are subsequently returned to the regional distribution center 417.

At the reuse/recycle center 423, the sizers (such as, the sizers 200) are automatically removed by a machine provided with a removal tool (such as, the removal tool 300). The removed sizers can be inspected, sorted, cleaned and packaged at the reuse/recycle center 423. Optionally, the removed sizers can be optionally transported to the sizer reuse/recycle center 460 for inspection, sorting, cleaning and packaging. The sizers can be sorted by their colors and/or sizes before being shipped to the offshore regional hanger distribution center 447. At the offshore regional hanger distribution center 447, the sizers are sold with reused/recycled hangers to offshore garment manufacturers 441. Presently, a significant percentage of garments sold in the retail stores 419 are manufactured off shore in areas such as China, Thailand, India, Turkey and countries of the Near East. These offshore garment manufacturers provide essentially the same function as the domestic manufacturers 405 inasmuch as each of these entities manufactures a garment, and then assembles a hanger, a sizer and the garment in an automated production line to form a product known as GOH (Garment On Hanger) which is ready for display in the retail stores 419. The GOH garments are then batched as indicated at 443 and shipped via international transport, in generally intermodal or airborne containers, to the regional distribution center 417.

Now referring back to the reuse/recycle center 423, it has been found that 10-30% of the hangers returned are no longer suitable for reuse because of excess wear, breakage, warpage, gum tags or other debris which cannot easily be removed.

The hangers that fail the inspection are returned via a distribution channel 425 to a location which grinds or granulates the rejected hanger as illustrated at 424. At location 424, the hangers are also separated to classify the hangers according to the material from which they were molded, with polypropylene and polystyrene being the two primary materials from which hangers are molded. The polypropylene granulated material is then used to mold consumer hangers as indicated at 429 which may be returned by a distribution channel 431 for sale to consumers. The metal parts of the hangers are also removed. The remaining material not suitable for remolding is shipped via channel 439 and sold as scrap as indicated at 433. The removed metal parts are also shipped via channel 439 and sold as scrap as indicated at 433.

At the reuse/recycle center 423, it has been found that at least 30-50% of the hangers that originally entered the recycling loop at 403 are available for redistribution. The hangers 411, with the sizers removed, are subsequently reshipped to the garment suppliers 405 as part of the order fulfillment at a supply line 435. The supply of hangers at the supply line 435 can be augmented by freshly molded hangers, as indicated at 403. The combined stream of recycled and new hangers 437 is returned to the garment suppliers 405, as shown in FIG. 10. It is contemplated that each hanger will pass through the loop 2 to 6 times before it becomes unrecoverable. The hangers shipped from the reuse/recycle center 423 for reuse can be shipped to either the U.S. or the offshore garment manufacturers. However, since it is contemplated that only 50-80% of the originally molded hangers will be reused the supply may only be sufficient to meet the demands of the closer, in this instance, the US garment manufacturers. The cost of molding compared with shipping internationally must also be taken into consideration when dealing with offshore garment manufacturers. However, the higher shipping costs are often outweighed to meet a particular customer's demand in an offshore country.

Alternatively or additionally, at the reuse/recycle center 423, the reusable hangers 411 can be shipped to the offshore regional distribution center 447. Thus, at the offshore regional distribution center 447, separate shipments of hangers and removable sizers can be made to the offshore garment manufacturers 441. A plurality of new removable sizers can be molded at a U.S. sizer manufacturing center 407 and shipped via channel 409 to the offshore regional distribution center 447.

Depending on the circumstance, it may be less expensive to mold the hangers at an offshore hanger manufacture 445 and ship the hangers 411 to the offshore regional hanger distribution center 447, than to mold and ship from the U.S. hanger manufacturing center 401.

Batches or bundles of removable sizers 413 can also be molded at the U.S. sizer manufacturing center 407 and shipped via distribution channels 409, 449 and 451 to the offshore regional distribution centers 447 and/or the offshore garment manufacturers 441.

Molding the removable sizers at a single location, such as, the location of the U.S. sizer manufacturing center 407, ensures that the colors chosen for the removable sizers are consistent when they arrive at the retail stores 419 even though the adjacent garments and hangers may have been assembled thousands of miles apart from each other. In addition, the bulk and size of the removable sizers 413 render them susceptible to transoceanic shipment and use.

While in the shown embodiment, the removable sizers are all molded in a single location, it would be entirely possible to mold the removable sizers in one or more offshore molding facilities, provided precise control is maintained over the pigments used in the color indexing scheme.

There may also be a flow of returned surplus hangers as indicated along distribution channels 450 and 450*a*, which may be used to augment the supply of hangers at the reuse/recycle center 435 instead of molding new hangers at the U.S. hanger manufacturing center 401.

Figure 11:
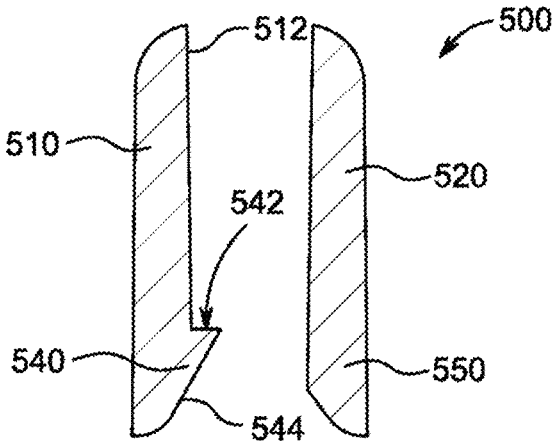
FIG. 11 is a section view of another sizer according to another exemplary embodiment of the present disclosure.
Figure 12:
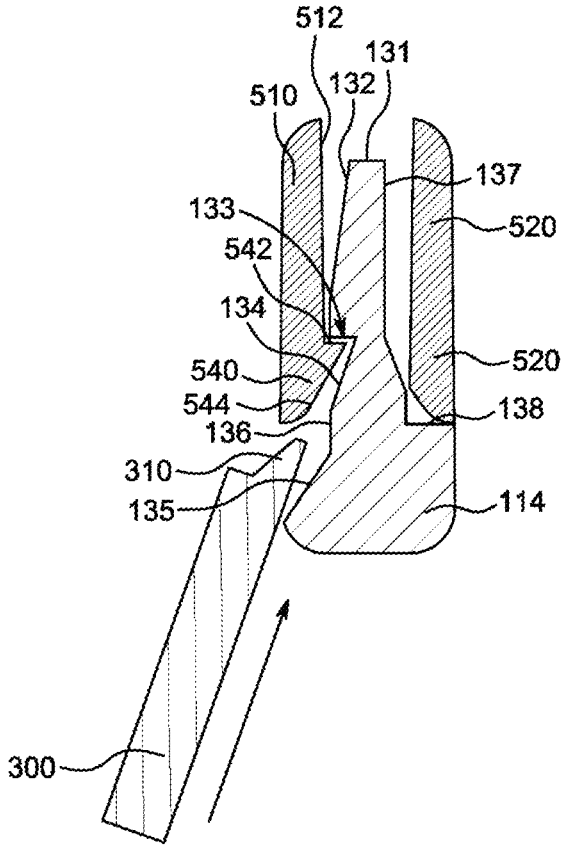
FIG. 12 is a sectional view of the sizer and the hanger after the sizer has been attached to the hanger.

FIG. 11 is a section view of a sizer 500 according to another exemplary embodiment of the present disclosure. FIG. 12 is a sectional view of the sizer 500 and the hanger 100 after the sizer has been attached to the hanger 100.

The sizer 500 includes a pair of substantially parallel panels 510 and 520. The first 510 panel has an inwardly extending finger 540 formed integrally therewith. The inwardly extending finger 540 is configured to operatively engage the sizer attachment structure 130 of the hook, as shown in FIG. 12.

The inwardly extending finger 540 includes an engaging surface 542, which is formed angularly with respect to an inner surface 512 of the first panel 510. The inwardly extending finger 540 further includes a sloped surface 544, which is formed angularly with respect to the engaging surface 542. Both the engaging surface 542 and the slopes surface 544 can be non-planar, such as, curved or rounded Different from the previous embodiment, the second panel 520 does not have an inwardly extending finger formed thereon. Thus, the first panel 510 and the second panel 520 are not structurally symmetric. As a result, when the sizer 500 is being attached to the hanger 100, the orientation of the sizer 500 with respect to the hanger 100 needs to be determined prior to the attachment of the sizer 500, for the purpose of properly attaching the sizer 500.

As shown in FIG. 12, when the sizer 500 has been attached to the hanger 100, the engaging surface 542 of the inwardly extending finger 510 engages the ledge 133 of the web 131, thereby allowing the sizer 200 to be positively, yet removably, mounted to the sizer attachment structure 130 of the hook 110.

The mounted sizer 500 can be selectively removed by a finger of a user's hand. Alternatively, the mounted sizer can be selectively removed, either manually or automatically, by using a removal tool.

FIGS. 13A-13F schematically illustrates, in a non-exclusive manner, certain hanger and sizer combinations, which are within the scope of the present disclosure.

Figure 13A:
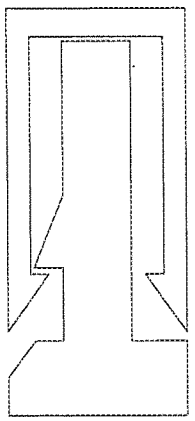
FIGS. 13A-13F schematically illustrates exemplary configurations of the sizer and hanger combination according to the present disclosure.

FIG. 13A shows the configuration described previously with respect to the sizer 200 and the hanger 100. In this configuration, the sizer is constructed symmetrically, having two symmetric inwardly extending fingers. The sizer attachment structure of the hanger 100 is constructed asymmetrically, in which either the front side or the rear side of the sizer attachment structure is provided with a ledge for engaging a respective inwardly extending finger. In operation, the orientation of the sizer with respect to the front side or rear side of the hanger does not affect how the sizer is mounted to the hanger. In addition, in light the asymmetrical configuration of the sizer attachment structure of the hanger, the sizer is removable from a side of the hanger, which is provided with a space for removing the sizer by a tool (either manually or automatically) or a finger of a user. FIG. 13D is a mirror image of FIG. 13A, for showing that the configuration of the sizer and the sizer attachment structure can be reversed in the front and rear direction without comprising the performance of the hanger and the sizer.

Figure 13B:
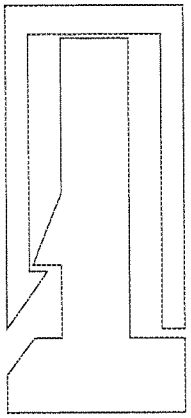

FIG. 13B shows the configuration described previously with respect to the sizer 500 and the hanger 100. In this configuration, the sizer is constructed asymmetrically, having only one inwardly extending finger provided at either the front side or the rear side of the sizer. The sizer attachment structure of the hanger 100 is also constructed asymmetrically, with either the front side or the rear side of the sizer attachment structure having a ledge for engaging the inwardly extending finger. In operation, the orientation of the sizer with respect to the front side or rear side of the hanger needs to be determined prior to attaching the sizer to the hanger. The sizer is removable from a side of the hanger, which is provided with a space for removing the sizer by a tool (either manually or automatically) or a finger of a user. FIG. 13E is a mirror image of FIG. 13B, for showing that the configuration of the sizer and the sizer attachment structure can be reversed in the front and rear direction without comprising the performance of the hanger and the sizer.

Figure 13C:
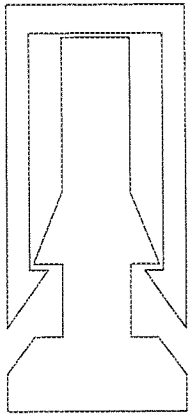
Figure 13D:
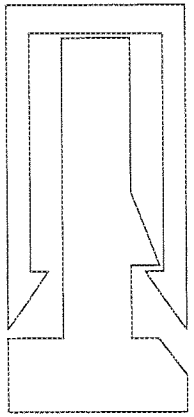
Figure 13E:
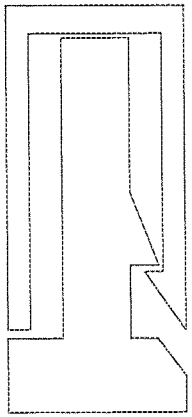

FIG. 13C shows another configuration of the sizer and hanger combination. In this configuration, the sizer is constructed symmetrically, having two inwardly extending fingers provided at both the front side and the rear side of the sizer. The sizer attachment structure of the hanger is also constructed symmetrically, with both the front side and the rear side of the sizer attachment structure having a ledge for engaging the respective inwardly extending finger. In addition, both the front side and the rear side of the sizer attachment structure are provided with a space for removing the sizer. The orientation of the sizer with respect to the front side or rear side of the hanger does not affect how the sizer is mounted to the hanger. In addition, the sizer is removable from either side of the hanger by a tool (either manually or automatically) or a finger of a user.

Figure 13F:
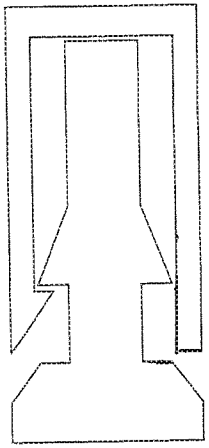

FIG. 13F shows yet another configuration of the sizer and hanger combination. In this configuration, the sizer is constructed asymmetrically, having only one inwardly extending finger provided at either the front side or the rear side of the sizer. The sizer attachment structure of the hanger is constructed symmetrically, with both the front side and the rear side of the sizer attachment structure having a ledge for engaging the respective inwardly extending finger. Both the front side and the rear side of the sizer attachment structure are provided with a space for removing the sizer. In operation, the orientation of the sizer with respect to the front side or rear side of the hanger does not affect how the sizer is mounted to the hanger. The sizer is removable from a side of the hanger that engages the inwardly extending finger of the sizer, by a tool (either manually or automatically) or a finger of a user.

While there have been shown and described what are considered to be the preferred embodiments of the invention, it will, of course, be understood that various modifications and changes in form or detail can be readily made without departing from the spirit of the invention. It is therefore intended that the invention not be limited to the exact form and detail herein shown and described nor to anything less than the whole of the invention herein disclosed as hereinafter claimed.

The invention claimed is:

1. A method of reusing hangers and sizers, comprising:

collecting a plurality of hanger-and-sizer combinations each comprising a sizer removably attached to a respective hanger;

automatically removing the sizers from the hangers to provide a plurality of hangers and a plurality of sizers;

shipping the plurality of hangers and the plurality of sizers to a hanger distribution center, wherein the plurality of hangers and the plurality of sizers are processed at the hanger distribution center to provide a plurality of sorted hangers and a plurality of sorted sizers;

shipping the plurality of sorted hangers and the plurality of sorted sizers to a plurality of remote garment manufacturers at remote locations, wherein the plurality of sorted hangers and the plurality of sorted sizers are reused at the plurality of remote garment manufacturers to provide a plurality of garment-on-hanger products;

returning a definable percentage of hanger-and-sizer combinations from the plurality of retail stores to the regional distribution center;

shipping the definable percentage of hanger-and-sizer combinations to a recycle center;

at the recycle center, automatically removing the sizers from the definable percentage of hanger-and-sizer combinations to provide a second plurality of selected hangers and a second plurality of selected sizers for reuse;

shipping the second plurality of selected hangers and the second plurality of selected sizers to the hanger distribution center, wherein the second plurality of selected hangers and the second plurality of selected sizers are processed to provide a second plurality of sorted hangers and a second plurality of sorted sizers;

shipping the second plurality of sorted hangers and the second plurality of sorted sizers to the plurality of remote garment manufacturers, wherein the second plurality of sorted hangers and the second plurality of sorted sizers are reused to provide a second plurality of garment-on-hanger products; and shipping the second plurality of garment-on-hanger products to the regional distribution center or the plurality of retail stores;

wherein the definable percentage of hanger-and-sizer combinations are shipped to the recycle center after being packed into a plurality of hanger boxes, the plurality of hangers boxes each comprising a respective bar code; and wherein, at the recycle center, the hanger boxes are weighed and the barcodes of the hanger boxes are scanned for collecting data usable to monitor the return rate of the hangers and sizers.

2. The method according to claim 1, further comprising shipping the plurality of garment-on-hanger products to a regional distribution center or a plurality of retail stores.

3. The method of reusing hangers and sizers according to claim 2, wherein the number of the plurality of selected sizers for reuse ranges from 50% to 80% of the number of the sizers of the first plurality of garment-on-hanger products.

4. The method according to claim 1, further comprising, prior to the returning the definable percentage of hanger-and-sizer combinations:

shipping a plurality of hangers from a hanger manufacturing center to a plurality of garment manufacturers at scattered geographic locals;

shipping a plurality of sizers from a sizer manufacturing center to the plurality of garment manufacturers, wherein the plurality of sizers are configured to be removably attached to the plurality of hangers, respectively;

at the plurality of garment manufacturers, attaching the plurality of sizers to the plurality of hangers respectively, thereby providing a plurality of hanger-and-sizer combinations;

at the plurality of garment manufacturers, assembling the plurality of garments to the plurality of hanger-and-sizer combinations respectively, thereby providing the first plurality of garment-on-hanger products each;

shipping the first plurality of garment-on-hanger products to the regional distribution center;

shipping the first plurality of garment-on-hanger products from the regional distribution center to the plurality of retail stores at scattered geographic locals, wherein the garments are at least partially sold to consumers and consequently removed from the first plurality of garment-on-hanger products at the plurality of retail stores.

5. The method of reusing hangers and sizers according to claim 1, further comprising repeating all the steps to form a plurality of loops of reusing hangers and sizers.

6. The method of reusing hangers and sizers according to claim 5, wherein the plurality of loops of reusing hangers and sizers comprises 2-6 loops.

7. The method of reusing hangers and sizers according to claim 1, wherein the automatically removing the sizers from the definable percentage of hanger-and-sizer combinations to provide the plurality of selected hangers and the plurality of selected sizers for reuse at the recycle center further comprises inspecting, cleaning, sorting and packing the removed sizers and the hangers.

8. The method of reusing hangers and sizers according to claim 1, wherein the hanger manufacturing center, the sizer manufacturing center and the plurality of garment manufacturers can be located offshore and the regional distribution center and the plurality of retail stores can be located in the United States.

9. The method of reusing hangers and sizers according to claim 1, wherein the hanger distribution center is located offshore.

10. The method of reusing hangers and sizers according to claim 1, wherein the definable percentage of hanger-and-sizer combinations ranges from 65% to 95% of the hanger-and-sizer combinations of the first plurality of garment-on-hanger products.

11. The method of reusing hangers and sizers according to claim 1, wherein the number of the plurality of selected hangers for reuse ranges from 50% to 80% of the number of the hangers of the first plurality of garment-on-hanger products.

12. The method according to claim 1, wherein said reuse of the plurality of sorted hangers and plurality of sorted sizers comprises attaching a sizer to a hanger having a sizer attachment structure, wherein said attaching comprises:

moving an inwardly extending finger of the sizer along a slope of the sizer attachment structure; and after the inwardly extending finger passes the slope, engaging the inwardly extending finger with a ledge of the sizer attachment structure to positively attach the sizer to the sizer attachment structure.

13. The method according to claim 1, wherein said automatically removing the sizers from the hangers comprises removing a sizer attached to a sizer attachment structure of a hanger, said removing comprising:

manipulating the sizer to release an engagement between an inwardly extending finger of the sizer and a ledge of the sizer attachment structure; and moving the sizer away from the sizer attachment structure to remove the sizer from the hanger.

14. The method according to claim 13, wherein said reuse of the plurality of sorted hangers and plurality of sorted sizers comprises attaching a sizer to a hanger having a sizer attachment structure, wherein said attaching comprises:

moving an inwardly extending finger of the sizer along a slope of the sizer attachment structure; and after the inwardly extending finger passes the slope, engaging the inwardly extending finger with a ledge of the sizer attachment structure to positively attach the sizer to the sizer attachment structure.

15. The method according to claim 13, wherein the manipulating the sizer to release the engagement comprises manually manipulating the sizer to release the engagement between the inwardly extending finger and the ledge.

16. The method according to claim 15, wherein the manually manipulating the sizer to release the engagement comprises manually manipulating the sizer with a tool.

17. The method according to claim 15, wherein the manually manipulating the sizer to release the engagement comprises manually manipulating the sizer with a finger of a user.

18. The method according to claim 13, wherein the manipulating the sizer to release the engagement comprises automatically manipulating the sizer to release the engagement between the inwardly extending finger and the ledge.

19. The method according to claim 18, wherein the automatically manipulating the sizer to release the engagement comprises automatically manipulating the sizer with a tool.

* * * * *